US006473651B1

(12) United States Patent
Kuzma et al.

(10) Patent No.: US 6,473,651 B1
(45) Date of Patent: Oct. 29, 2002

(54) FLUID FILLED MICROPHONE BALLOON TO BE IMPLANTED IN THE MIDDLE EAR

(75) Inventors: Janusz A. Kuzma, Englewood, CO (US); Thomas J. Balkany, Coral Gables, FL (US); William Vanbrooks Harrison, Valencia, CA (US)

(73) Assignee: Advanced Bionics Corporation, Sylmar, CA (US)

( * ) Notice: Subject to any disclaimer, the term of this patent is extended or adjusted under 35 U.S.C. 154(b) by 0 days.

(21) Appl. No.: 09/514,100

(22) Filed: Feb. 28, 2000

Related U.S. Application Data

(60) Provisional application No. 60/122,373, filed on Mar. 2, 1999.

(51) Int. Cl.[7] ..... H04R 25/00
(52) U.S. Cl. ..... 607/57; 600/587
(58) Field of Search ..... 607/55–57; 600/587

(56) References Cited

U.S. PATENT DOCUMENTS

| | | | | | |
|---|---|---|---|---|---|
| 3,882,285 | A | | 5/1975 | Nunley et al. | 179/107 |
| 4,267,410 | A | | 5/1981 | Forster et al. | 179/107 |
| 4,428,377 | A | | 1/1984 | Xollner et al. | 128/419 |
| 4,988,333 | A | * | 1/1991 | Engerbretson et al. | 600/25 |
| 5,085,628 | A | | 2/1992 | Engebertson et al. | 600/25 |
| 5,277,694 | A | | 1/1994 | Leysieffer et al. | 600/25 |
| 5,554,096 | A | | 9/1996 | Ball | 600/25 |
| 5,603,726 | A | | 2/1997 | Schulman et al. | 607/57 |
| 5,624,376 | A | | 4/1997 | Ball et al. | 600/25 |
| 5,772,575 | A | | 6/1998 | Lesinski et al. | 600/25 |
| 5,782,744 | A | | 7/1998 | Money | 600/25 |
| 5,814,095 | A | | 9/1998 | King | 607/46 |
| 5,859,916 | A | | 1/1999 | Ball et al. | 381/326 |
| 5,881,158 | A | | 3/1999 | Lesinski et al. | 381/174 |
| 5,888,187 | A | | 3/1999 | Jaeger et al. | 600/23 |
| 5,906,635 | A | | 5/1999 | Maniglia | 607/57 |
| 5,984,859 | A | * | 11/1999 | Lesinski | 128/898 |
| 6,005,955 | A | | 12/1999 | Kroll et al. | 381/328 |
| 6,216,040 | B1 | * | 4/2001 | Harrison | 607/57 |

FOREIGN PATENT DOCUMENTS

| | | |
|---|---|---|
| WO | 9715125 | 4/1997 |
| WO | 9906108 | 2/1999 |

OTHER PUBLICATIONS

US 5,730,699, 3/1998, Adams et al. (withdrawn)

* cited by examiner

*Primary Examiner*—Kennedy Schaetzle
(74) *Attorney, Agent, or Firm*—Bryant R. Gold

(57) ABSTRACT

An implantable microphone system, usable with a cochlear implant system or other hearing aid prosthesis, detects sound pressure waves (acoustic waves) at a movable member within the middle ear, e.g., the tympanic membrane or the stapes, through a fluid communication channel (20) established between the middle ear movable member and a microphone capsule (10). The microphone capsule (10) includes two compartments (11, 12) separated by a flexible diaphragm (13). One compartment (12) is in fluid communication with a thin-walled balloon, filled with a suitable fluid (30), positioned in contact with the movable member within the middle ear. The other compartment (11) is mechanically coupled through a suitable mechanical linkage (16) to a microphone sensor (14). The microphone sensor, in turn, is electrically connected to the cochlear implant system or other hearing aid prosthesis.

18 Claims, 4 Drawing Sheets

FLUID FILLED MICROPHONE BALLOON TO BE IMPLANTED IN THE MIDDLE EAR

This application claims the benefit of U.S. Provisional Application Serial No. 60/122,373, filed Mar. 2, 1999, which application is incorporated herein by reference.

BACKGROUND OF THE INVENTION

The present invention relates to an implantable microphone system that is useable with cochlear implants or implantable hearing aids, and more particularly to an implantable microphone system that senses motion of the tympanic membrane and transfers such motion to a microphone sensor via a fluid communication channel.

A cochlear implant is an electronic device designed to provide useful hearing and improved communication ability to individuals who are profoundly hearing impaired and unable to achieve speech understanding with hearing aids. Hearing aids (and other types of assistive listening devices) make sounds louder and deliver the amplified sounds to the ear. For individuals with a profound hearing loss, even the most powerful hearing aids may provide little to no benefit.

A profoundly deaf ear is typically one in which the sensory receptors of the inner ear, called hair cells, are damaged or diminished. Making sounds louder or increasing the level of amplification, e.g., through the use of a hearing aid, does not enable such an ear to process sound. In contrast, cochlear implants bypass damaged hair cells and directly stimulate the hearing nerves with electrical current, allowing individuals who are profoundly or totally deaf to receive sound.

In order to better understand how a cochlear implant works, and how the present invention is able to function, it is helpful to have a basic understanding of how the ear normally processes sound. The ear is a remarkable mechanism that consists of three main parts: the outer ear, the middle ear and the inner ear. The outer ear comprises the visible outer portion of the ear and the ear canal. The middle ear includes the eardrum (or tympanic membrane) and three tiny bones. The inner ear comprises the fluid-filled snail-shaped cochlea which contains thousands of tiny hair cells.

When the ear is functioning normally, sound waves travel through the air to the outer ear, which collects the sound and directs it through the ear canal to the middle ear. The sound waves strike the eardrum, or tympanic membrane, and cause it to vibrate. This vibration creates a chain reaction in the three tiny bones in the middle ear. These three tiny bones are medically termed the malleus, incus and stapes, but are also commonly referred to as the "hammer", "anvil" and "stirrup". Motion of these bones, in turn, generates movement of the oval window, which in turn causes movement of the fluid contained in the cochlea.

The cochlea is lined with thousands of tiny sensory receptors commonly referred to as hair cells. As the fluid in the cochlea begins to move, the hair cells convert these mechanical vibrations into electrical impulses and send these signals to the hearing nerves. The electrical energy generated in the hearing nerves is sent to the brain and interpreted as "sound".

In individuals with a profound hearing loss, the hair cells are damaged or depleted. In these cases, electrical impulses cannot be generated normally. Without these electrical impulses, the hearing nerves cannot carry messages to the brain, and even the loudest of sounds may not be heard.

Although the hair cells in the cochlea may be damaged, there are usually some surviving hearing nerve fibers. A cochlear implant works by bypassing the damaged hair cells and stimulating the surviving hearing nerve fibers with an electrical signal. The stimulated nerve fibers then carry the electrical signals to the brain, where they are interpreted as sound.

Representative cochlear implant devices are described in U.S. Pat. Nos. 4,267,410; 4,428,377; 4,532,930; and 5,603,726, incorporated herein by reference.

Cochlear implants currently use external microphones placed on the body that pick up sound (sense acoustic pressure waves and convert them to electrical signals) and then transmit the electrical signals to a signal processor for amplification, processing and conversion into an electrical stimulation signal (either current or voltage) that is applied to the surviving acoustic nerves located in the cochlea. Such a microphone is, by design, very sensitive, and in order to be sensitive, is by its nature very fragile. Disadvantageously, the external microphone can be damaged if it becomes wet, is dropped or is exposed to extreme conditions frequently encountered in the external environments. These fragile and sensitive microphones also restrict the user's lifestyle and activities. For example, when a user must wear a microphone, he or she is restricted from participation in swimming and other sports, e.g., contact sports, unless the microphone is removed during such activities. If the microphone is removed, however, the user no longer is able to hear. Moreover, many users also find an external microphone cosmetically objectionable since they appear out of place and mark the user as "needing assistance".

There have been a number of published concepts for implantable microphones which can be used with implantable hearing aids and cochlear implants. In such concepts, it is common to attempt to utilize the acoustic characteristics of the human ear to improve sound quality and obtain some directionality. The general concept in these proposals is based on the common idea of implanting some type of acoustic sensor in the inner ear cavity and to couple it mechanically to the acoustic chain.

The most popular approach discussed in the art to mechanically couple an acoustic sensor to the acoustic chain is to clamp the driving element to the malleus, incus or stapes. Disadvantageously, this approach suffers from several drawbacks: (1) the complexity of placement of the clamping elements, (2) the long-term stability of the clamp and clamping elements, (3) a degradation of performance due to ingrowth of tissue into the middle ear, and (4) potential damage to the malleus, incus or stapes bones.

It thus is evident that improvements are needed in the way users of a cochlear implant, or other hearing aid systems, sense or hear sounds, and more particularly, it is evident that improvements are needed in the implantable microphones used with such systems.

BRIEF SUMMARY OF THE INVENTION

The present invention addresses the above and other needs by providing an implantable microphone system, usable with a cochlear implant system or other hearing aid prosthesis. Such microphone system detects sound pressure waves (acoustic waves) sensed at the tympanic membrane of a patient through a fluid communication channel established between the middle-ear side of the tympanic membrane and an implantable microphone capsule. The implantable microphone capsule includes first and second compartments separated by a flexible diaphragm. The second compartment is in fluid communication with a thin-walled balloon positioned in contact with the tympanic membrane within the middle ear. The first compartment includes a microphone sensor, adapted to transduce mechanical motion to an electrical signal. Such microphone sensor is mechanically coupled through a mechanical linkage to the flexible diaphragm. The microphone sensor, in turn, is electrically connected to the cochlear implant system or other hearing aid prosthesis.

In accordance with one aspect of the invention, fluid communication is established between the thin-walled balloon within the middle ear (which is in contact with a middle-ear component, such as the middle ear side of the tympanic membrane, or the stapes) and the flexible diaphragm within the microphone capsule via a flexible tube. A suitable fluid, such as a natural saline solution, is injected into the balloon, tube and second compartment within the microphone capsule via an injection port formed in the wall of the microphone capsule and fluid compartment. Such injection port comprises a penetratable seal, e.g., penetratable by a hypodermic needle. In addition to allowing a suitable volume of fluid to be injected into the fluid communication link, such injection port also allows air or other gases to be vented therefrom.

In operation, vibrations (physical movement) of the tympanic membrane, or other middle ear components, caused by sound pressure waves sensed through the outer ear canal, are coupled through the fluid communication system to the flexible diaphragm within the microphone capsule. Movement of the flexible diaphragm, in turn, is sensed by the microphone sensor and transduced to an electrical signal which is forwarded to the hearing aid prosthesis, e.g., a cochlear implant system.

It is thus an object of the present invention to provide an implantable microphone system usable with an implantable cochlear stimulation system.

It is a feature of the invention to provide an implantable microphone system that allows sound waves, collected through the patient's outer ear, to be sensed and converted to electrical signals representative of the sensed sound, which electrical signals may then be processed in accordance with a suitable speech processing strategy and converted to stimulation signals adapted to stimulate the patient's auditory nerve through an electrode array implanted within the patient's cochlea.

It is a further feature of the invention to provide an implantable microphone system that relies upon a fluid communication channel to transfer pressure waves sensed within the middle ear, e.g., at the tympanic membrane or the stapes, to an implantable, yet outside-of-the middle-ear, microphone capsule whereat such pressure waves may be converted to a suitable electrical signal.

It is still another feature of the invention to provide such an implantable microphones system wherein motion or movement of a middle ear component, such as the tympanic membrane or the stapes, is sensed through the use of a thin-walled, fluid-filled, balloon placed in contact with the middle ear components, e.g., immediately behind the tympanic membrane, i.e., on the middle-ear side of the tympanic membrane, or in contact with the stapes.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
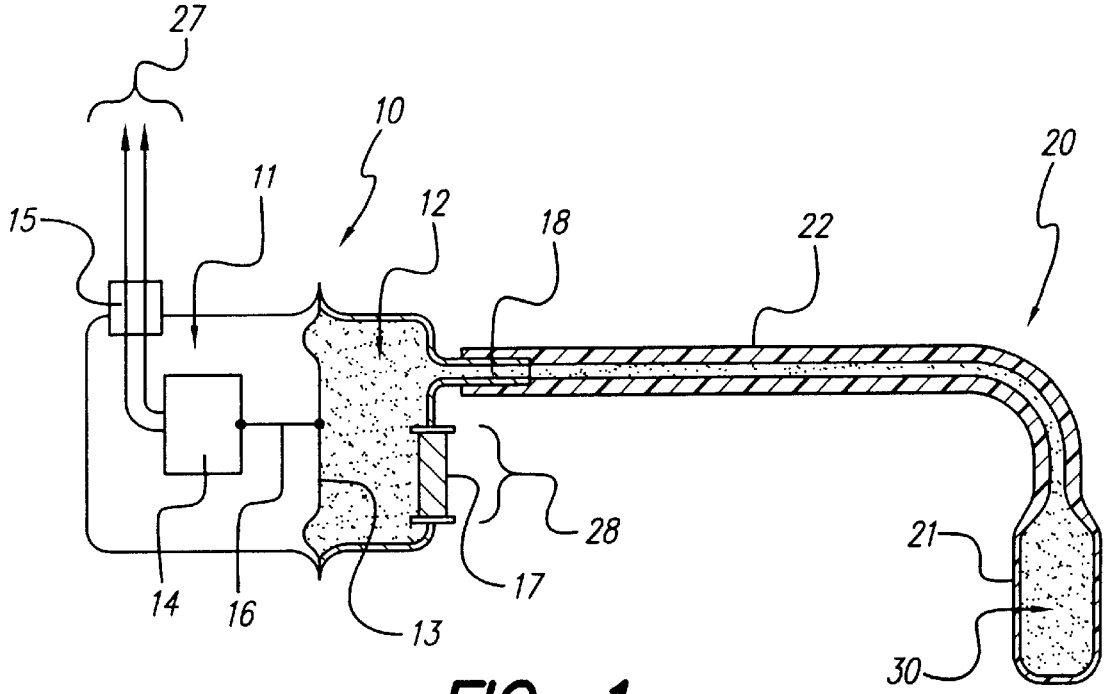
FIG. 1 schematically illustrates the three main components of the invention: a microphone capsule 10, a thin-wall balloon system 20, and a coupling fluid 30.

The present invention is directed to an implantable microphone system. Such system will typically be used by a patient or user having a cochlear prosthesis; but could also be used with any type of hearing aid system where a microphone is needed. A schematic representation of the invention is depicted in FIG. 1. As seen in FIG. 1, the invention includes three main components: (1) a microphone capsule 10; (2) a thin-walled balloon system 20 comprising a balloon 21 and connecting tube 22 made from a biocompatible polymer (such as silicone rubber); and (3) a coupling fluid 30, e.g., natural saline.

The microphone capsule 10 has a first compartment 11 and a second compartment 12 separated by a flexible membrane or diaphragm 13. The first compartment 11 is hermetically sealed and includes a microphone sensor 14 coupled by a mechanical link 16 with the flexible diaphragm 13. The microphone sensor 14 may be any suitable sensor known in the art, e.g., a piezoelectric transducer, that converts movement of the flexible diaphragm 13, as sensed through the mechanical link element 16, to an electrical signal. The electrical signal generated by the microphone sensor 14 is delivered through suitable hermetic feedthrough terminals 15 to wire conductors 27 which carry the signal to a suitable speech processor, as explained more fully below in conjunction with FIG. 4.

The second compartment 12 of the microphone capsule 10 has a connecting port 18 that connects with the flexible polymer tube 22. The tube 22, in turn, is joined with the thin-walled, pillow-shaped, balloon 21 that forms part of the balloon system 20.

The balloon system 20 is implantable within the middle ear of the patient. The system 20 includes the pillow-shaped thin-walled balloon 21 with integral flexible connecting tube 22.

The balloon system 20, including the balloon 21 and tube 22, and second compartment 12 are filled with a suitable fluid 30. It is the function of the fluid 30 to transfer pressure waves caused by motion of the patient's tympanic membrane to the flexible diaphragm 13 within the microphone capsule 10. To this end, the tube 22 provides a fluid communication channel between the balloon 21 and the chamber 12 so that pressure waves introduced at the balloon, e.g., caused by flexing or movement of the balloon wall, are transferred to the flexible diaphragm, 12. Thus, the microphone sensor 14 within the first chamber 11 of the microphone capsule 10 senses movement of the flexible diaphragm 13, which movement corresponds to movement of the walls of the balloon 21 as sensed through the fluid communication channel, or tube 22. When the balloon 21 is inplanted so that its wall is adjacent to and in contact with the tympanic membrane, then movements of the tympanic membrane are transferred to the balloon walls. As a result, the microphone sensor 14 generates an electrical signal representative of the movement of the tympanic membrane.

As further seen in FIG. 1, the microphone capsule 10 further includes an injection port 17 that allows the second chamber 12, as well as the balloon system 20, to be filled with the fluid 30. This injection port 17 also allows air bubbles (or other undesirable gaseous bubbles) to be removed from the chamber 12 and balloon system 20. The injection port 17 may be realized through the use of a suitable semipermeable membrane that seals an opening 28 in the exterior wall of the capsule 10 that defines the second compartment 12. Such membrane may be easily pierced by a sharp instrument, such as a hypodermic needle, for the purpose of injecting the fluid 30 into the fluid system and for removing air bubbles therefrom.

The second compartment 12 of the microphone capsule 10, including the balloon system 20, is made from materials selected to make the system water-tight, i.e., a closed system. Thus, a change of the contents of system occurs only by diffusion to keep in balance with the body fluid(s) when the system is implanted.

In a preferred embodiment, the fluid 30 comprises a natural saline liquid without air bubbles. It is to be understood, however, that other types of fluids may be used, including both liquid and gaseous fluids. Further, a different fluid may be used within the compartment 12 than is used within the balloon system 20, e.g., a first fluid 30' within the compartment 12, and a second fluid 30" within the balloon system 20, which two fluids are then in contact with each other through a thin membrane separator strategically placed at some point between the two fluid systems, e.g., at the inlet port to the chamber 12.

Figure 2:
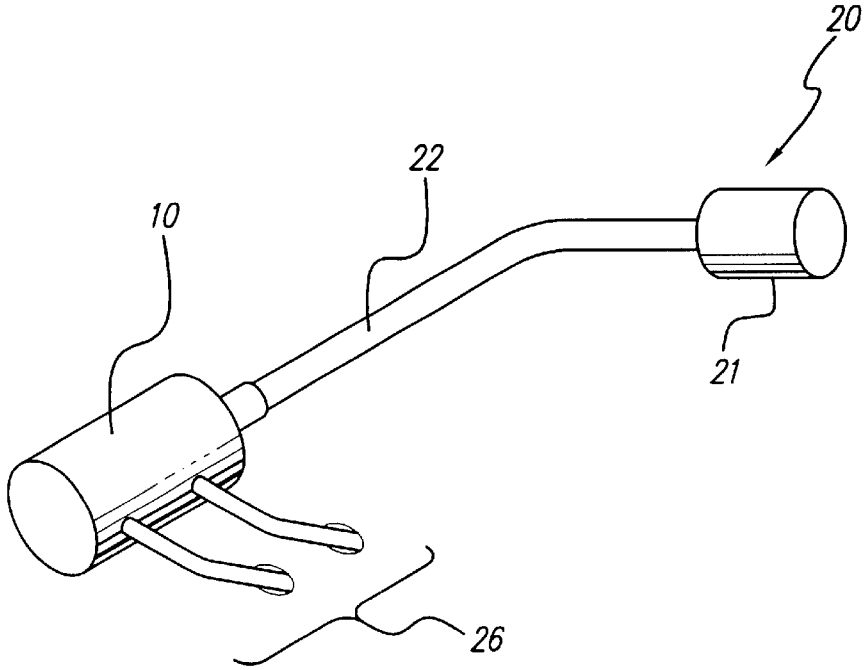
FIG. 2 is a perspective view of an the implantable microphone made in accordance with the invention.

Turning next to FIG. 2, there is shown is a perspective view of an the implantable microphone system made in accordance with the invention. The microphone system includes the microphone capsule 10 and the balloon system 20. The balloon system 20 includes the thin-walled balloon 21 and connecting tube (or fluid communication channel) 22. The microphone capsule 10 includes a system of attachment to surrounding bone (or other) tissue. In the embodiment shown in FIG. 2, such attachment system includes a plurality of barbed pins 26 that protrude out from the capsule 10. These barbed pins or tines 26 are configured to be pushed into pre-drilled holes in the surrounding bone tissue.

Figure 3:
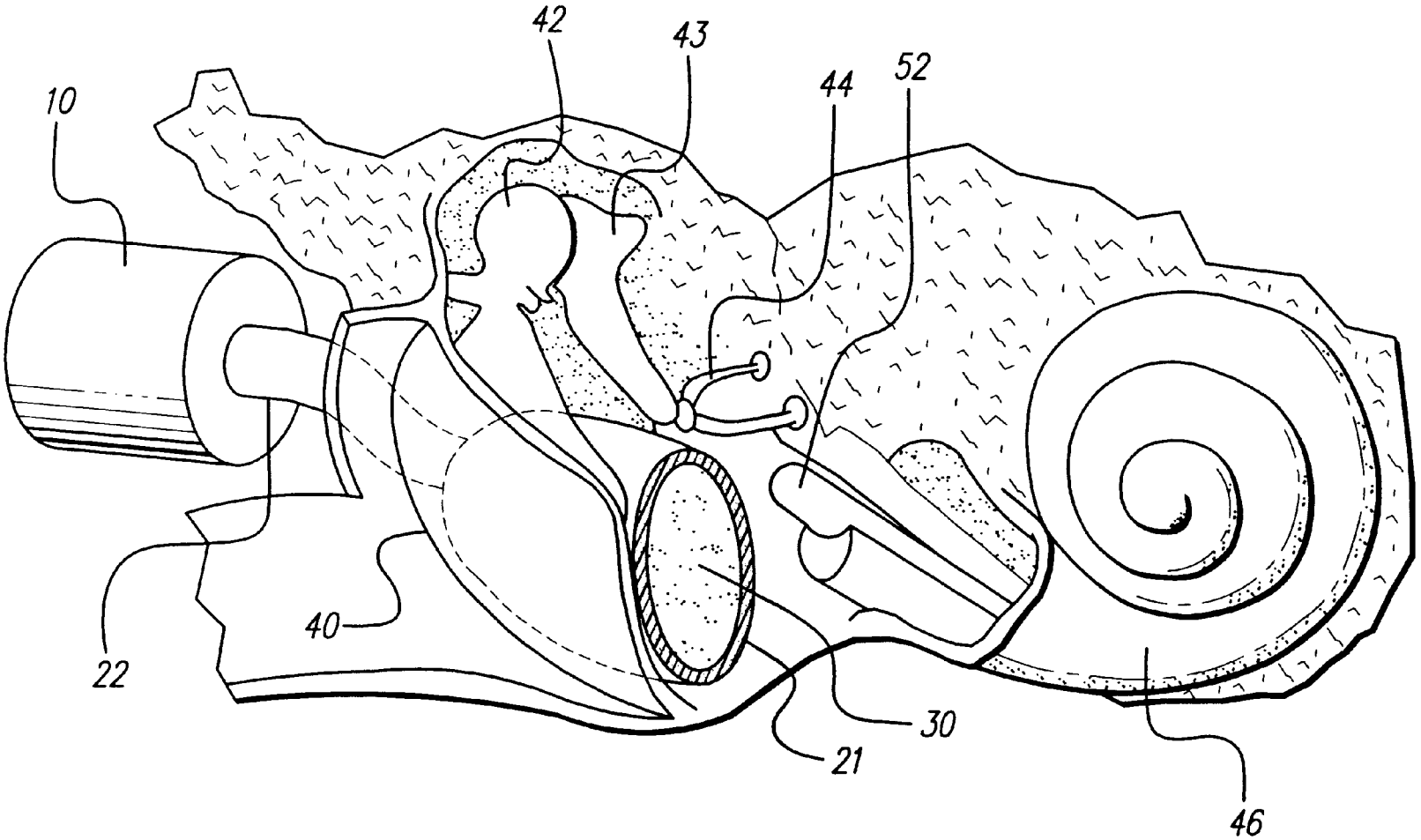
FIG. 3 anatomically illustrates the positioning of the microphone system when implanted within and near the middle ear.

Turning next to FIG. 3, the manner of implanting the microphone system will be described. FIG. 3 anatomically illustrates the preferred positioning of the microphone system when implanted within and near the middle ear of a patient. Advantageously, the microphone system may be implanted during a standard cochlear implant placement without any additional preparation. A normal mastoid cavity is formed in conventional manner. As part of this process, the mastoid cavity, when exposed by folding over the facia and skin flap, is drilled for placement of a cochlear electrode system 52 within the snail-shaped cochlea 46 of the patient. After insertion of the electrode system 52 into the cochlea 46, and fixation of the cochlear stimulator (not shown in FIG. 3) attached to the electrode system 52, the balloon 21 is placed through the facial recess behind the tympanic membrane 40. Due to is size and flexible nature, the balloon 21 remains in contact with the back of the tympanic membrane (i.e., the side of the tympanic membrane within the middle ear) and is supported at the promontory.

The microphone capsule 10 is placed within the mastoid cavity using a suitable system of attachment. For example, barbed pins 26 may be pushed into pre-drilled holes in the mastoid bone. The microphone output wires 27 (FIG. 1) are then connected to the speech processing system. The connecting tube 22 is laid down within the mastoid cavity. The facia and skin flap are then replaced over the opening and sutured for closure.

Figure 4:
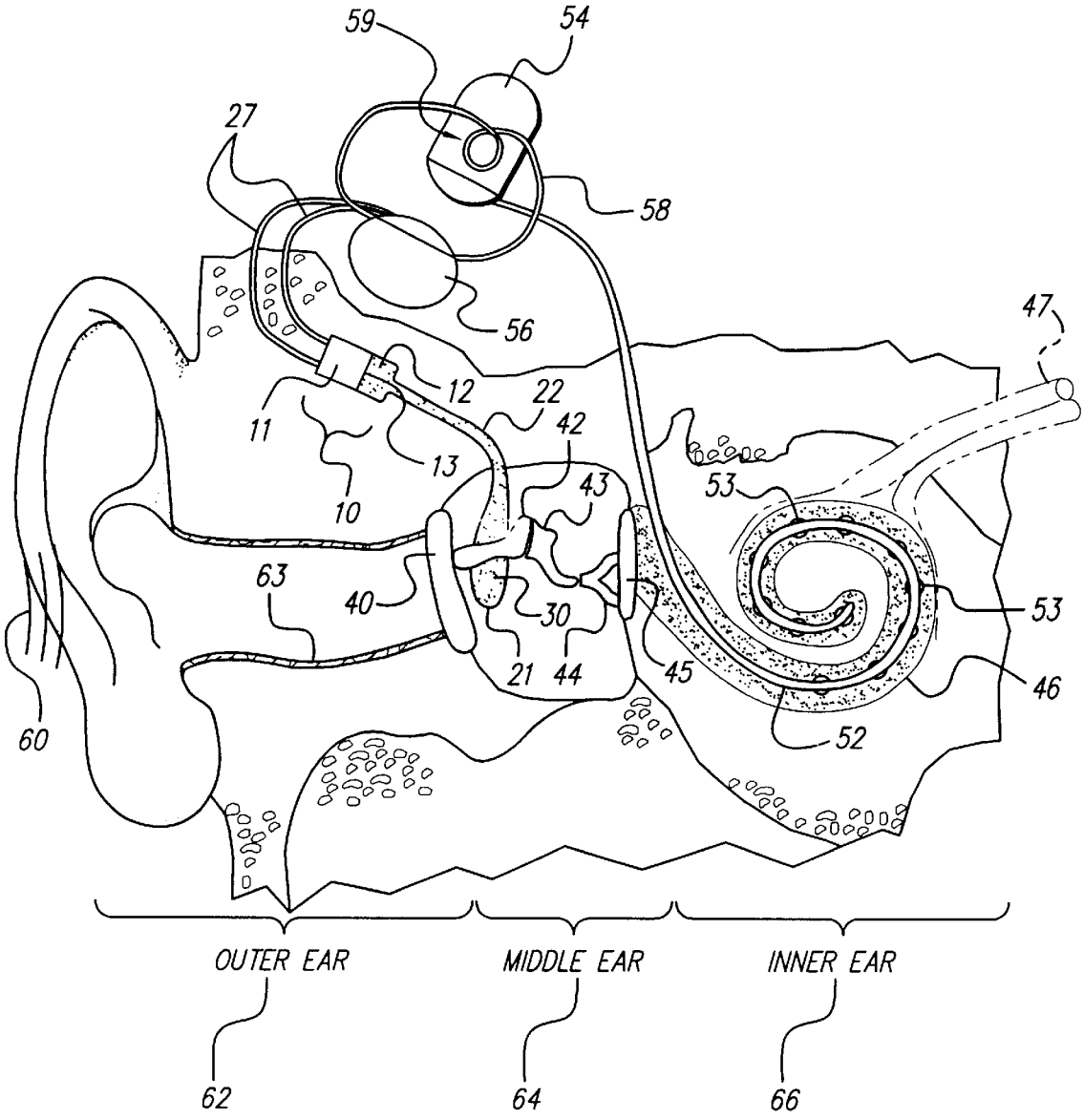
FIG. 4 schematically depicts one location within the middle ear of a thin walled balloon used as part of the implantable microphone system of the present invention, and further illustrates use of the implantable microphone system with one type of cochlear implant system.

Turning next to FIG. 4, the operation of the implantable microphone system will be described in connection with a cochlear implant system. FIG. 4 schematically illustrates one position for the thin walled balloon within the middle ear and shows the use of the implantable microphone with a cochlear implant system. The cochlear implant system depicted in FIG. 4 includes an implantable cochlear stimulator (ICS) 54 coupled to an implantable speech processor (ISP) 56 by way of a coupling wire 58 formed in a loop 59. Other types of coupling between the ISP 56 and the ICS 54 may, of course, also be used. The speech processor, for example, could be an external (non-implanted) speech processor, if desired. Alternatively, the ISP 56 and ICS 54 may be housed within the same package. Various types of fully implantable, and partially implantable, cochlear stimulation systems are described in PCT Publication WO99/06108, published Feb. 11, 1999, corresponding to PCT Patent Application Ser. No. PCT/US98/15996, which publication is incorporated herein by reference, any of which could be used with the present invention. Indeed, the microphone of the present invention is not limited to a particular type of cochlear stimulation system, but may be used with any type of hearing aid device.

As seen in FIG. 4, sound waves 60 travel through the air to the outer ear 62, which collects the sound and directs it through the ear canal 63 to the middle ear 64. The sound waves 60 strike the eardrum, or tympanic membrane 40, and cause it to vibrate. In a functioning ear, this vibration creates a chain reaction in the three tiny bones in the middle ear, the malleus 42, the incus 43 and the stapes 44. Motion of these bones, in turn, generates movement of the oval window 45, which in turn causes movement of the fluid contained in the cochlea 46, which in turn triggers the hair cells and excites the auditory nerve, as explained previously.

A patient using a cochlear implant system, however, does not have a fully functioning ear. In fact, such patients may not have a functioning middle ear 64, or other defects or disease may prevent sound waves 60 form being transferred to the hair cells in the cochlea.

As seen in FIG. 4, the sound waves 60 are picked up by the eardrum 40, i.e., they cause the tympanic membrane (eardrum) 40 to vibrate as a function of the intensity and frequency of the sound. These vibrations are transferred to the fluid 30 inside of the balloon 21. These vibrations are then carried by the fluid 30, through the tube 22, to the diaphragm 13 within the microphone capsule 10. In this manner, the diaphragm 13 is caused to vibrate as a function of the intensity and frequency of the sound waves 60.

The vibrations of the diaphragm 13 are detected by the microphone transducer sensor 14 (FIG. 1) within the first compartment 11 of the microphone capsule 10. As explained previously, such detection includes converting the sensed vibrations to electrical signals that are present on microphone output wires 27. The wires 27 are connected to the ISP 56, or other suitable processor. The ISP 56 processes the electrical signals in accordance with a selected speech processing strategy and sends control signals, e.g., via the looped coil 59, to the ICS 54. The ICS 54 responds to the control signals by generating appropriate electrical stimuli which is delivered to individual electrode contacts 53 spaced apart on the electrode array 52. These electrical stimuli excite neurons embedded within the modiolar wall of the cochlea 46, causing nerve impulses to be sent through the auditory nerve 47 to the patient's brain, thereby allowing the patient to experience the sensation of hearing based on the sound waves 60 collected in his or her outer ear 62.

Figure 5:
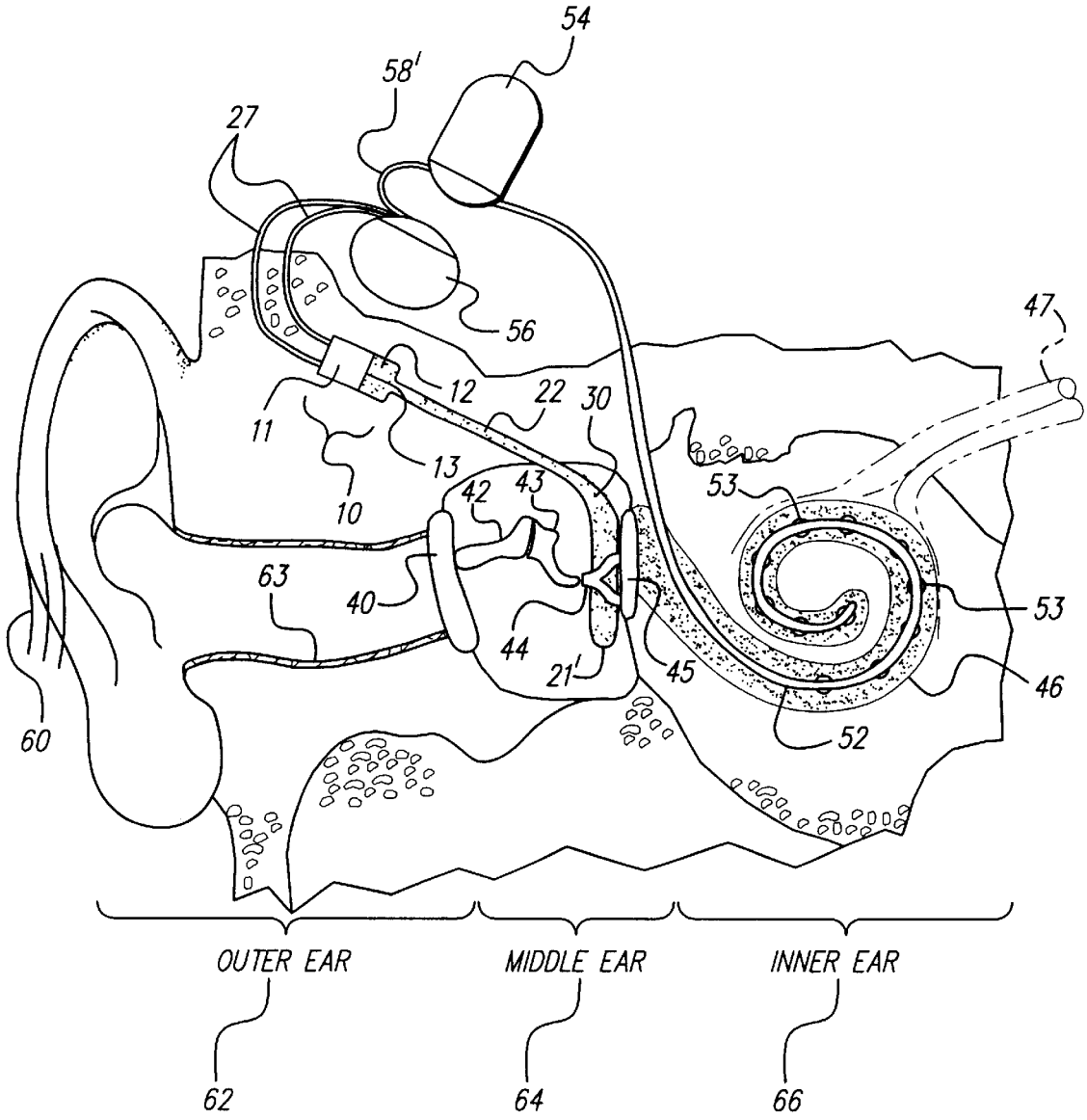
FIG. 5 schematically illustrates an alternative position for the thin walled balloon within the middle ear, and illustrates use of the implantable microphone with another type of cochlear implant system.

Turning next to FIG. 5, there is shown a schematic diagram similar to that shown in FIG. 4, but with the thin walled balloon 21', which forms part of the implantable microphone, being located at a different location within the middle ear 64. Rather than being placed so as to contact the middle-ear side of the tympanic membrane 40 (as shown in FIG. 4), the thin walled balloon 21' shown in FIG. 5 is placed so as to be in contact with the stapes 44. The embodiment of the invention illustrated in FIG. 5 is particularly suited for patients having a functioning middle ear because it allows the tympanic membrane 40, as it vibrates as a result of sensed sound waves, to drive the malleus 42 (which is the normal load driven by the malleus). The malleus 42, in turn, drives or vibrates the incus 43, which drives or vibrates the stapes 44. The stapes, in turn vibrates the thin walled balloon 21', which is a liquid medium (and which thus represents the normal type of load driven by the stapes—a fluid-filled medium). The positioning of the thin-walled balloon 21' shown in FIG. 5 thus represents a better impedance match for the incoming sound waves. That is, for the embodiment shown in FIG. 5, the tympanic membrane 40 will not be unduly damped or restricted from vibrating as it could be when a fluid-filled medium is in contact with it.

In operation, the embodiment of the invention depicted in FIG. 5 operates essentially the same as that described above in connection with FIG. 4. That is, the sound waves 60 are picked up by the eardrum 40, i.e., they cause the tympanic membrane (eardrum) 40 to vibrate as a function of the intensity and frequency of the sound. These vibrations are transferred through the incus 43 and stapes 44, to the fluid 30 inside of the thin-walled balloon 21'. These vibrations are then carried by the fluid 30, through the tube 22, to the diaphragm 13 within the microphone capsule 10. In this manner, the diaphragm 13 is caused to vibrate as a function of the intensity and frequency of the sound waves 60.

Still with reference to FIG. 5, the vibrations of the diaphragm 13 are detected by the microphone transducer sensor 14 (FIG. 1) within the first compartment 11 of the microphone capsule 10. As explained previously, such detection includes converting the sensed vibrations to electrical signals that are present on microphone output wires 27. The wires 27 are connected to the ISP 56, or other suitable processor. The ISP 56 processes the electrical signals in accordance with a selected speech processing strategy and sends control signals, e.g., via cable 58', to the ICS 54. The ICS 54 responds to the control signals by generating appropriate electrical stimuli that are delivered to individual electrode contacts 53 spaced apart on the electrode array 52. These electrical stimuli excite neurons embedded within the modiolar wall of the cochlea 46, causing nerve impulses to be sent through the auditory nerve 47 to the patient's brain, thereby allowing the patient to experience the sensation of hearing based on the sound waves 60 collected in his or her outer ear 62.

A more detailed description of a fully implantable cochlear stimulation system of the type shown in FIGS. 4 and 5 may be found in U.S. patent application Ser. No. 09/404,966, filed Sep. 24, 1999, now U.S. Pat. No. 6,308,101; or Ser. No. 09/126,615, filed Jul. 31, 1998, now U.S. Pat. No. 6,067,474, both of which applications are incorporated herein by reference.

As described above, it is thus seen that the present invention provides an implantable microphone system usable with an implantable cochlear stimulation system. It is further seen that such system allows sound waves, collected through the patient's outer ear, to be sensed and converted to electrical signals representative of the sensed sound. These electrical signals may then be processed in accordance with a suitable speech processing strategy and converted to stimulation signals adapted to stimulate the patient's auditory nerve through an electrode array implanted within the patient's cochlea.

As further described above, it is seen that the present invention provides an implantable microphone system that utilizes a fluid communication channel to transfer pressure waves sensed within the middle ear, e.g., at the tympanic membrane, or at the stapes, to an implantable, yet outside-of-the middle-ear, microphone capsule. It is within this microphone capsule where the transferred pressure waves are converted to an electrical signal.

Finally, it is seen that the present invention provides an implantable microphone system wherein motion or movement of one or more middle ear components of a patient's middle ear, e.g., movement of the tympanic membrane or movement of the stapes, is sensed through the use of a thin-walled, fluid-filled, balloon system placed in contact with the moving middle ear component, i.e., immediately behind the tympanic membrane, i.e., on the middle-ear side of the tympanic membrane, or in contact with the stapes. Advantageously, such sensing system is reliable, is stable over a long period of time, does not damage the middle ear bones, and does not promote tissue ingrowth within the middle ear.

While the invention herein disclosed has been described by means of specific embodiments and applications thereof, numerous modifications and variations could be made thereto by those skilled in the art without departing from the scope of the invention set forth in the claims.

What is claimed is:

1. An implantable microphone system, usable by a patient having a cochlear prosthesis, comprising:

a microphone capsule having first and second chambers separated by a flexible diaphragm, the second chamber having a first fluid therein;

a microphone sensor within the first chamber that is in mechanical contact with the flexible diaphragm, the microphone sensor comprising a transducer that converts movement of the flexible diaphragm to an electrical signal;

a balloon implantable in the middle ear of the patient, the balloon having a second fluid therein, and having a wall adapted to be coupled with a movable component of the middle ear, wherein movement of the middle ear component causes the balloon wall to also move;

a fluid communication channel coupling the first fluid within the second compartment of the microphone capsule with the first fluid inside of the balloon, wherein vibrations of the balloon wall are coupled through the fluid communication channel to the flexible diaphragm within the microphone capsule;

wherein the microphone sensor of the first chamber of the microphone capsule senses movement of the flexible diaphragm, which movement of the flexible diaphragm corresponds to movement of the middle ear component sensed through the fluid communication channel, whereby the microphone sensor generates an electrical signal representative of the movement of the middle ear component.

2. An implantable microphone system as set forth in claim 1 wherein the first fluid and the second fluid are the same fluid.

3. The implantable microphone system as set forth in claim 2 wherein the first and second fluids comprise a liquid.

4. The implantable microphone system as set forth in claim 3 wherein the first and second fluids comprise a saline solution.

5. The implantable microphone system as set forth in claim 2 wherein the first and second fluids comprise a gas.

6. The implantable microphone system as set forth in claim 1 wherein the fluid communication channel comprises a flexible tube that connects the second chamber of the microphone capsule with the inside of the balloon.

7. The implantable microphone system as set forth in claim 1 wherein the microphone capsule further includes means for securing the capsule to surrounding tissue when the capsule is implanted in tissue.

8. The implantable microphone system as set forth in claim 7 wherein the means for securing the capsule to surround tissue comprises at least one barbed pin protruding from the capsule for attachment to surround bone tissue.

9. The implantable microphone system as set forth in claim 1 wherein the microphone capsule further includes a semipermeable membrane that defines a portion of the second chamber, wherein a needle may be inserted through the semipermeable membrane to inject and remove fluids to and from the second chamber, and hence to and from the fluid communication system.

10. The implantable microphone system as set forth in claim 1 wherein the balloon comprises a thin-walled balloon having a pillow shape.

11. The implantable microphone system as set forth in claim 1 wherein the wall of the balloon is adapted to be coupled to the middle-ear side of the tympanic membrane.

12. The implantable microphone system as set forth in claim 1 wherein the wall of the balloon is adapted to be coupled to the stapes within the middle ear of the patient.

13. An implantable microphone system comprising:

means for sensing motion of a movable member within the middle ear of a patient from a location within the middle ear, wherein the means for sensing motion of the movable member within the middle ear comprises a balloon filled with a fluid positioned within the middle ear, and wherein one wall of the balloon contacts the movable member within the middle ear; and means for converting the sensed motion of the tympanic membrane to an electrical signal.

14. The implantable microphone system as set forth in claim 13 wherein the movable member within the middle ear that is in contact with one wall of the balloon is selected from the group comprising: the middle-ear side of the tympanic membrane, the malleus, the incus, the stapes, and the middle-ear side of the oval window membrane.

15. The implantable microphone system as set forth in claim 13 wherein the means for converting the sensed motion of the movable middle ear member comprises:

a flexible diaphragm in fluid communication with the fluid within the balloon, and means for converting motion of the flexible diaphragm to an electrical signal that varies in magnitude and time synchronization with movement of the flexible diaphragm.

16. An implantable microphone system comprising:

a flexible diaphragm;

a fluid communication system coupled between a movable member within the middle ear of a patient and the flexible diaphragm, whereby movement of the movable middle ear member is transferred through the fluid communication system to cause the flexible diaphragm to move; and a sensor that senses movement of the flexible diaphragm and generates an electrical signal as a function of the sensed movement.

17. A method of sensing acoustic signals and producing an electrical signal representative of the sensed acoustic signals comprising:

coupling motion of a movable member within the middle ear of a patient to a remote flexible diaphragm further comprising:

implanting a thin-walled balloon in the middle ear of the patient so that a wall of the balloon is in contact with the movable member;

implanting a microphone capsule in a cavity adjacent the middle ear, the microphone capsule having two chambers separated by the flexible diaphragm;

connecting a tube between the inside of the thin-walled balloon and one of the chambers of the microphone capsule;

filling the balloon, tube and chamber of the microphone capsule connected to the tube with a fluid, wherein motion of the movable member within the patient's middle ear is coupled through the fluid to the flexible diaphragm within the microphone capsule and causes the flexible diaphragm to move; and converting motion of the flexible diaphragm to an electrical signal.

18. The method of claim 17 wherein the step of converting motion of the flexible diaphragm to an electrical signal comprises placing a mechanical-to-electrical transducer in mechanical contact with the flexible diaphragm within the microphone capsule, wherein the transducer generates an electrical signal proportional to the amount of movement of the flexible diaphragm.

* * * * *